US008377234B2

(12) United States Patent
Yilbas et al.

(10) Patent No.: US 8,377,234 B2
(45) Date of Patent: Feb. 19, 2013

(54) METHOD OF NITRIDING NICKEL-CHROMIUM-BASED SUPERALLOYS

(75) Inventors: Bekir Sami Yilbas, Dhahran (SA); Syed Sohail Akhtar, Dhahran (SA); Cihan Karatas, Ankara (TR)

(73) Assignee: King Fahd University of Petroleum and Minerals, Dhahran (SA)

( * ) Notice: Subject to any disclaimer, the term of this patent is extended or adjusted under 35 U.S.C. 154(b) by 376 days.

(21) Appl. No.: 12/662,621

(22) Filed: Apr. 26, 2010

(65) Prior Publication Data

US 2011/0259475 A1 Oct. 27, 2011

(51) Int. Cl.
*C23C 8/02* (2006.01)
*C23C 8/24* (2006.01)

(52) U.S. Cl. ..... 148/224

(58) Field of Classification Search ..... 148/224
See application file for complete search history.

(56) References Cited

U.S. PATENT DOCUMENTS

| | | | | |
|---|---|---|---|---|
| 3,989,559 | A | 11/1976 | Lin et al. | |
| 4,004,891 | A | 1/1977 | Lin et al. | |
| 4,043,839 | A | 8/1977 | Hartline, III et al. | |
| 4,264,380 | A | 4/1981 | Rose et al. | |
| 4,451,302 | A | 5/1984 | Prescott et al. | |
| 4,588,450 | A * | 5/1986 | Purohit | 148/238 |
| 5,252,145 | A | 10/1993 | Tahara et al. | |
| 5,411,770 | A | 5/1995 | Tsai et al. | |
| 5,413,641 | A | 5/1995 | Coulon | |
| 6,630,768 | B2 | 10/2003 | Yamashiro et al. | |
| 2002/0004356 | A1 * | 1/2002 | Wern | 451/36 |

FOREIGN PATENT DOCUMENTS

| | | |
|---|---|---|
| CN | 1074489 (A) | 7/1993 |
| EP | 1329533 (A1) | 7/2003 |
| GB | 2282149 (A) | 3/1995 |
| JP | 55134171 (A) | 10/1980 |
| JP | 58084107 (A) | 5/1983 |
| JP | 6025824 (A) | 2/1994 |
| KR | 20020089994 (A) | 11/2002 |
| KR | 20080062651 (A) | 7/2008 |
| RU | 2164964 (C1) | 4/2001 |

* cited by examiner

*Primary Examiner* — Jessee R. Roe
(74) *Attorney, Agent, or Firm* — Richard C. Litman

(57) ABSTRACT

The method of nitriding nickel-chromium-based superalloys is a method of forming a nitride barrier layer on a surface of a nickel-chromium-based superalloy workpiece, such as an Inconel® 718 plate, using gas-assisted laser nitriding. The nickel-chromium-based superalloy workpiece is first cleaned, both with a chemical bath and then through an ultrasonic cleaning process. Following the cleaning of the workpiece, a laser beam is scanned over a surface of the nickel-chromium-based superalloy workpiece. A stream of nitrogen gas, which may be elemental nitrogen or nitrogen in the form of ammonia gas or the like, is sprayed on the surface of the nickel-chromium-based superalloy workpiece coaxially and simultaneously with the laser beam to form the nitride barrier layer.

5 Claims, 6 Drawing Sheets

METHOD OF NITRIDING NICKEL-CHROMIUM-BASED SUPERALLOYS

BACKGROUND OF THE INVENTION

1. Field of the Invention

The present invention relates generally to the nitriding of alloys, and particularly to a method of nitriding nickel-chromium-based superalloys using gas-assisted laser nitriding.

2. Description of the Related Art

Inconel® refers to a family of austenitic nickel-chromium-based superalloys produced by the Special Metals Corporation of New Hartford, N.Y. A "superalloy", or high-performance alloy, is an alloy that exhibits excellent mechanical strength and creep resistance at high temperatures, along with good surface stability, and corrosion and oxidation resistance. Superalloys typically have a matrix with an austenitic face-centered cubic crystal structure. A superalloy's base alloying element is typically nickel, cobalt, or nickel-iron. Superalloy development has relied heavily on both chemical and process innovations and has been driven primarily by the aerospace and power industries. Typical applications are in the aerospace, industrial gas turbine and marine turbine industry, e.g. for turbine blades for hot sections of jet engines.

Inconel® alloys are typically used in high temperature applications. Different Inconel® alloys have widely varying compositions, but all are predominantly nickel, with chromium as the second element. Table 1, below, shows the composition of three such superalloys, Inconel® 600, Inconel® 625 and Inconel® 718:

TABLE I

| | Element (% by mass) | | |
|---|---|---|---|
| Element | Inconel ® 600 | Inconel ® 625 | Inconel ® 718 |
| Ni | 72.0 | 58.0 | 50.0-55.0 |
| Cr | 14.0-17.0 | 20.0-23.0 | 17.0-21.0 |
| Fe | 6.0-10.0 | 5.0 | Balance |
| Mo | | 8.0-10.0 | 2.8-3.3 |
| Nb | | 3.15-4.15 | 4.75-5.5 |
| Co | | 1.0 | 1.0 |
| Mn | 1.0 | 0.5 | 0.35 |
| Cu | 0.5 | | 0.2-0.8 |
| Al | | 0.4 | 0.65-1.15 |
| Ti | | 0.4 | 0.3 |
| Si | 0.5 | 0.5 | 0.35 |
| C | 0.15 | 0.1 | 0.08 |
| S | 0.015 | 0.015 | 0.015 |
| P | | 0.015 | 0.015 |
| B | | | 0.006 |

Inconel® alloys are oxidation and corrosion resistant materials that are well suited for service in extreme environments. When heated, Inconel® alloys form a thick, stable, passivating oxide layer protecting the surface from further attack. Inconel® alloys retains strength over a wide temperature range, which is attractive for high temperature applications where aluminum and steel would succumb to creep as a result of thermally induced crystal vacancies. The Inconel® alloys' high temperature strength is developed by solid solution strengthening or precipitation strengthening, depending on the particular alloy. In age hardening or precipitation strengthening varieties, small amounts of niobium combine with nickel to form the intermetallic compound $Ni_3Nb$ or "gamma prime" (γ'). Gamma prime forms small cubic crystals that inhibit slip and creep effectively at elevated temperatures.

Inconel® alloys are difficult metals to shape and machine using traditional techniques due to their rapid work hardening. After the first machining pass, work hardening tends to plastically deform either the workpiece or the tool on subsequent passes. For this reason, age-hardened alloys, such as Inconel® 718, are machined using an aggressive but slow cut with a hard tool, minimizing the number of passes required. Alternatively, the majority of the machining can be performed with the workpiece in a solutionised form, with only the final steps being performed after age-hardening. External threads are machined using a lathe to "single point" the threads, or by rolling the threads using a screw machine. Holes with internal threads are made by welding or brazing threaded inserts made of stainless steel. Cutting of plate is often done with a waterjet cutter. Internal threads can also be cut by single point method on lathe, or by threadmilling on a machining center. New whisker reinforced ceramic cutters are also used to machine nickel alloys. They remove material at a rate typically eight times faster than carbide cutters. Inconel® 718 can also be roll threaded after full aging by using induction heat to 1300° F. without increasing grain size.

Nitriding is a heat-treating process that alloys nitrogen into the surface of a metal to create a case hardened surface. It is predominantly used on steel, but also titanium, aluminum and molybdenum. It would be desirable to provide the benefits of nitriding an alloy surface to a superalloy, such as the Inconel° alloys. The three main methods of nitriding typically used in industry are: gas nitriding, salt bath nitriding, and plasma nitriding. In gas nitriding, the donor is a nitrogen rich gas, such as ammonia ($NH_3$). When ammonia comes into contact with the heated work piece, it disassociates into nitrogen and hydrogen. The nitrogen then diffuses from the surface into the core of the material. Recent developments have lead to a process that can be accurately controlled. The thickness and phase constitution of the resulting nitriding layers can be selected, and the process can be optimized for the particular properties required.

In salt bath nitriding, the nitrogen-donating medium is a nitrogen containing salt, such as cyanide salt. The salts used also donate carbon to the workpiece surface, making salt bath a nitrocarburizing process. Plasma nitriding (also known as ion nitriding, plasma ion nitriding or glow-discharge nitriding) is an industrial surface hardening treatment for metallic materials. Typically, an ionized gas, such as nitrogen in a low-pressure regime, is reactive with the surface components of the workpiece. Plasmas, however, are not easy to work with or apply. Conventional gas nitriding and salt bath nitriding are not particularly effective on a superalloy, such as one of the Inconel® superalloys. It would be desirable to provide the benefits of a nitride surface to a nickel-chromium-based superalloy, such as one of the Inconel® superalloys, without the expense or difficulty of working with conventional nitrogen plasmas.

Inconel® 718, in particular, is widely used in the power industry, due to its high resistance to harsh environmental conditions. Niobium segregation, however, results in large scattering of the mechanical properties in the surface region of plates and other structures formed from Inconel® 718. Segregation is typically avoided through the formation of fine structures on the surface through laser-controlled melting. Although Inconel® 718 on its own is somewhat resistant to oxidation, the use of an assisting gas in the laser treatment process is typically deemed to be necessary in order to prevent the formation of oxide species at elevated temperatures in the laser-irradiated region.

As noted above, the assisting gas is typically an inert gas, such as atomic nitrogen (often from dissociated ammonia at high temperature, where the metallic surface acts as a catalyst in the uptake of nitrogen), which prevents the high temperature exothermic oxidation reactions at the surface. In addition to preventing oxidation, nitrogen acts in the formation of nitride species in the laser-irradiated region during the heating process.

Thus, a method of nitriding nickel-chromium-based superalloys solving the aforementioned problems is desired.

SUMMARY OF THE INVENTION

The method of nitriding nickel-chromium-based superalloys is a method of forming barrier nitride layers on surfaces of nickel-chromium-based superalloy workpieces, such as an Inconel® 718 plate. The nickel-chromium-based superalloy workpiece is first cleaned, both with a chemical bath and then through an ultrasonic cleaning process. Any suitable type of chemical bath for cleaning nickel-chromium-based alloys may be used, such as immersion in an alkaline potassium permanganate bath, followed by a sulfuric acid, sodium nitrate, copper sulfate solution, as is conventionally known. Similarly, any suitable type of ultrasonic cleaning process may be used.

Following cleaning the workpiece, a laser beam is scanned over a surface of the nickel-chromium-based superalloy workpiece. Preferably, the laser beam is produced by a carbon dioxide laser with a power intensity output of approximately 90 $W/m^2$. Scanning preferably occurs at a rate of approximately 10 cm/sec. A stream of nitrogen gas, which may be atomic nitrogen dissociated from ammonia at high temperature, is sprayed on the surface of the nickel-chromium-based superalloy workpiece coaxially and simultaneously with the laser beam at a relatively high pressure, such as at a pressure of approximately 500 kPa, thus forming a barrier nitride layer in the laser-irradiated region having a depth of approximately 40 μm.

BRIEF DESCRIPTION OF THE DRAWINGS

Similar reference characters denote corresponding features consistently throughout the attached drawings.

DETAILED DESCRIPTION OF THE PREFERRED EMBODIMENTS

The method of nitriding nickel-chromium-based superalloys is a method of forming barrier nitride layers on surfaces of nickel-chromium-based superalloy workpieces, such as an Inconel® 718 plate. Such barrier nitride layers protect the available oxidizing metallic species of the superalloy from oxidation, and further impede egress of surface dislocations, which tend to cause increases in fatigue and creep strengths.

Figure 1:
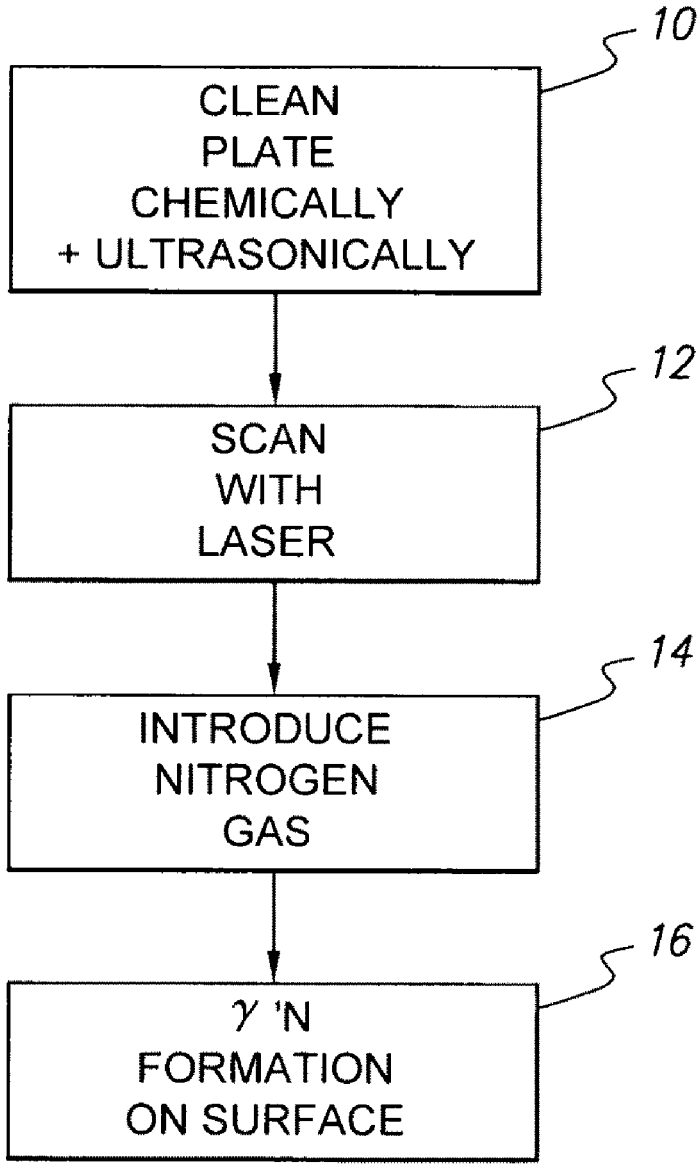
FIG. 1 is a flowchart showing the steps in a method of nitriding nickel-chromium-based superalloys according to the present invention.
Figure 2A:
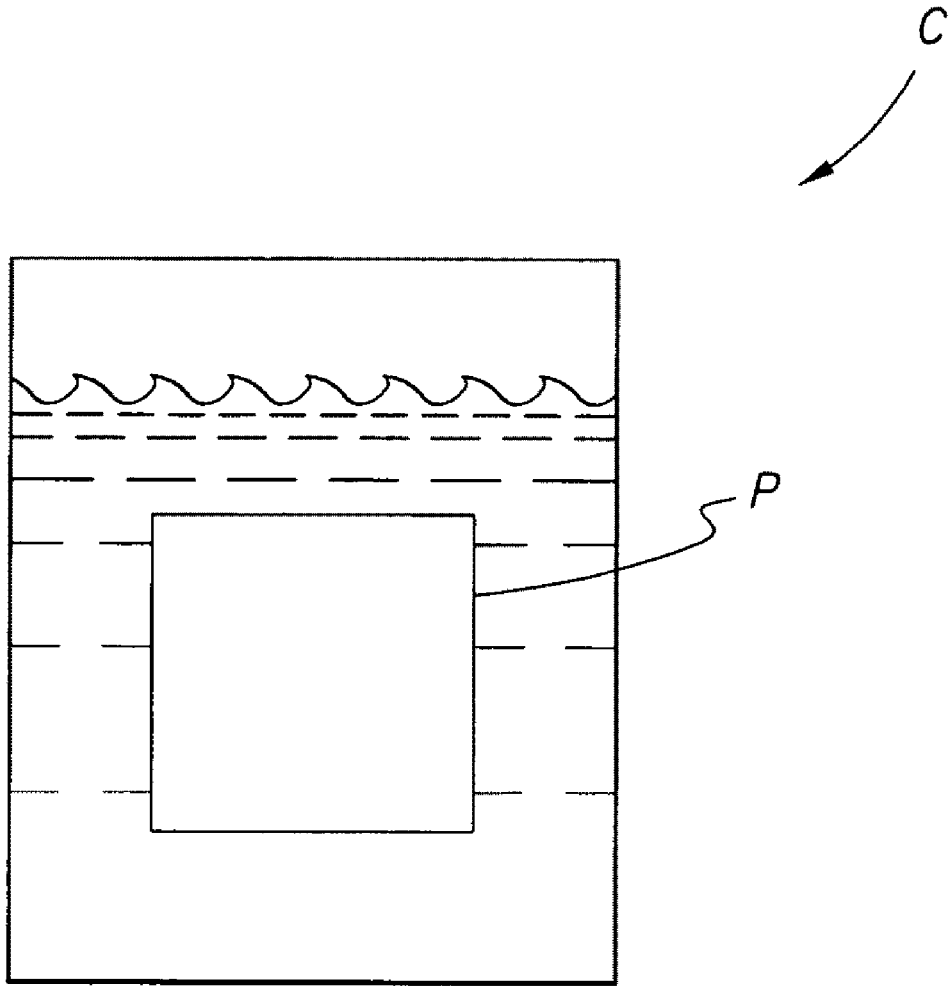
FIG. 2A is a diagrammatic view of a first cleaning step in a method of nitriding nickel-chromium-based superalloys according to the present invention.

The nickel-chromium-based superalloy workpiece is first cleaned, both with a chemical bath and then through an ultrasonic cleaning process (step 10 in FIG. 1). Any suitable type of chemical bath for cleaning nickel-cadmium-based alloys may be used, such as immersion in an alkaline potassium permanganate bath, followed by a sulfuric acid, sodium nitrate, copper sulfate solution, as is conventionally known. FIG. 2A diagrammatically illustrates a nickel-chromium-based superalloy plate P being cleaned in a chemical bath C.

Figure 2B:
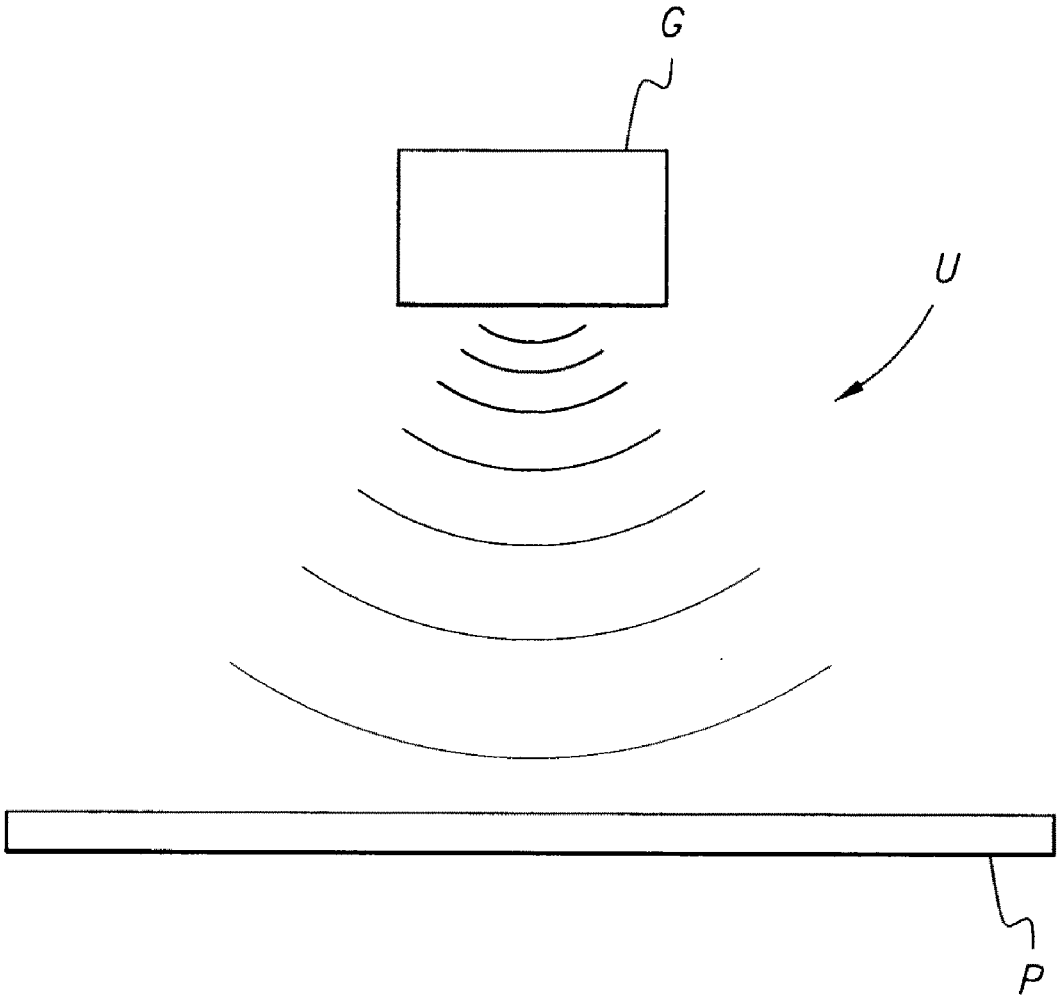
FIG. 2B is a diagrammatic view of a second cleaning step in a method of nitriding nickel-chromium-based superalloys according to the present invention.

Similarly, any suitable type of ultrasonic cleaning process may be used. Ultrasonic cleaners are well known in the art. One example of such a cleaner is shown in U.S. Pat. No. 6,630,768, which is hereby incorporated by reference. FIG. 2B diagrammatically illustrates plate P undergoing ultrasonic cleaning through the impingement thereon by ultrasonic waves U generated by an ultrasonic generator or transducer G.

Figure 2C:
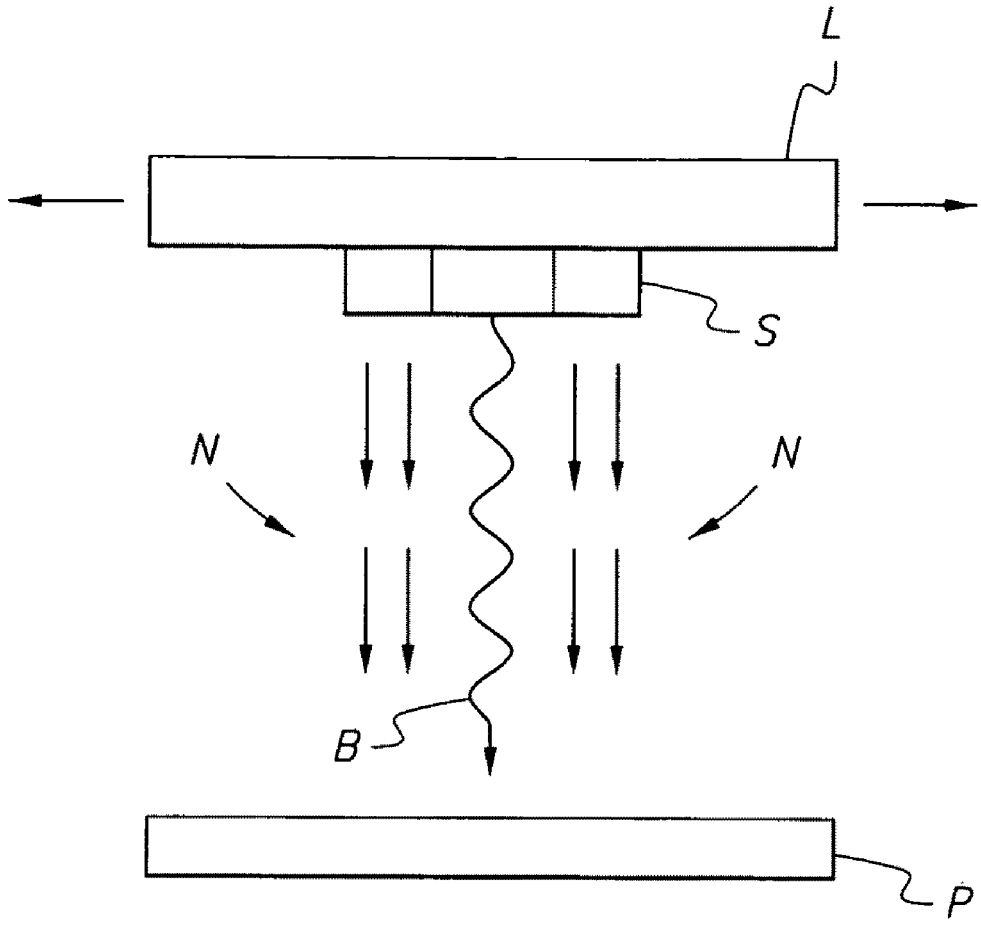
FIG. 2C is a diagrammatic view of gas-assisted laser nitriding step in a method of nitriding nickel-chromium-based superalloys according to the present invention.

As diagrammatically illustrated in FIG. 2C, following cleaning the plate P, a laser beam B is scanned over a surface of the nickel-chromium-based superalloy plate P (step 12 in FIG. 1). Preferably, the laser beam B is produced by a carbon dioxide laser L with a power intensity output of approximately 90 $W/m^2$. It should be understood that any suitable type of laser may be utilized. Scanning preferably occurs at a rate of approximately 10 cm/sec. The laser may be scanned and applied to the surface of the plate P by any suitable method of laser treatment. Such nitriding lasers and laser scanning systems are well known in the art. One such example is shown in U.S. Pat. No. 5,411,770, which is hereby incorporated by reference in its entirety.

Figure 3A:
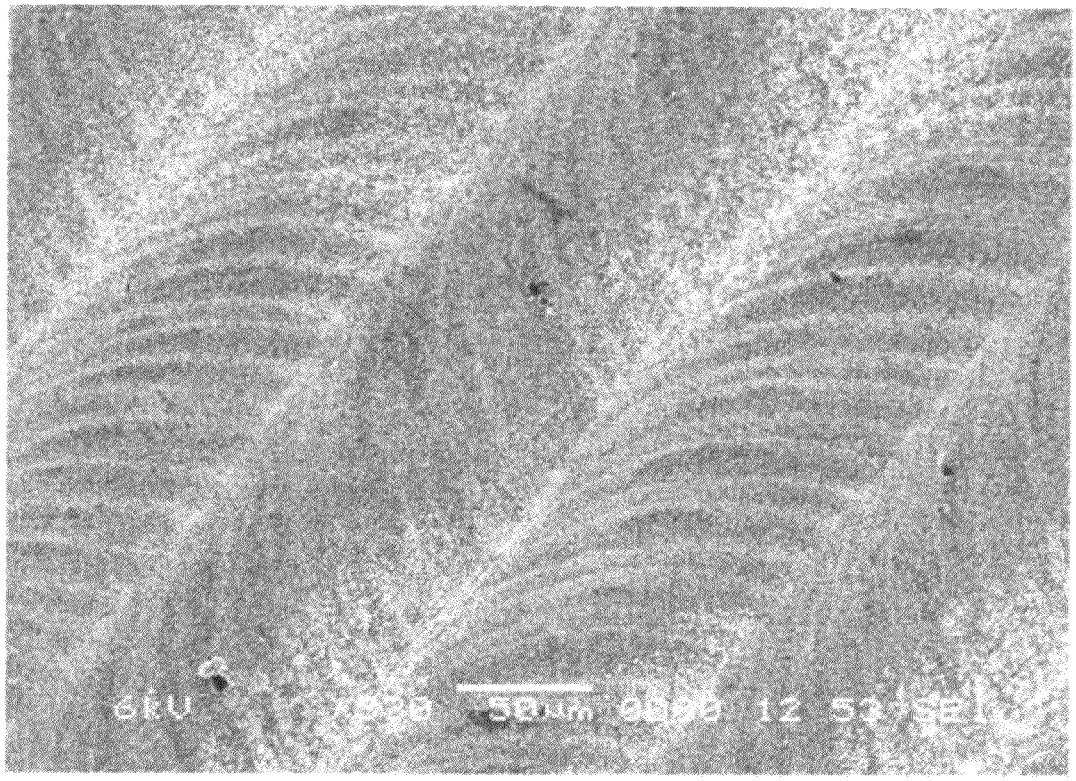
FIG. 3A is a scanning electron microscope micrograph image of a nitrided nickel-chromium-based superalloy surface produced by a method of nitriding nickel-cadmium-based superalloys according to the present invention.
Figure 3B:
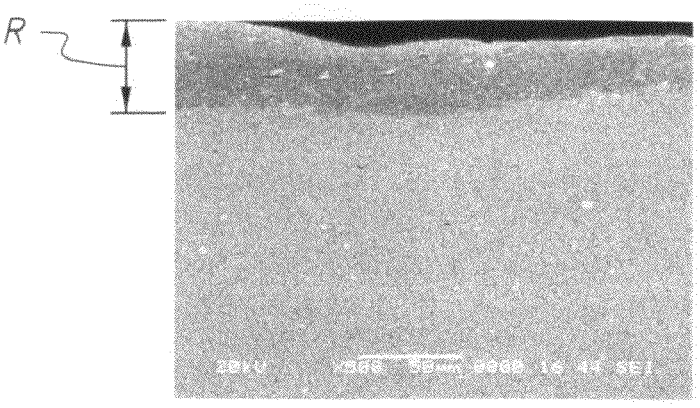
FIG. 3B is a scanning electron microscope micrograph image showing a cross-sectional view of the nitrided layer of the nickel-chromium-based superalloy workpiece of FIG. 3A.

A stream of nitrogen gas, which may be atomic nitrogen dissociated from ammonia at high temperature, is sprayed on the surface of the nickel-chromium-based superalloy workpiece coaxially and simultaneously with the laser beam at a relatively high pressure, such as a pressure of approximately 500 kPa (step 14 in FIG. 1), thus forming a barrier nitride layer in the laser-irradiated region having a depth of approximately 40 μm (step 16 in FIG. 1), FIG. 3A is a scanning electron microscope (SEM) micrograph image of the surface of an Inconel® 718 plate treated according to the present nitriding method. FIG. 3B is a cross-sectional view of the plate of FIG. 3A, illustrating the laser-treated region R at the surface.

It should be understood that sprayer S in FIG. 2C is shown for illustrative purposes only, as is the stream of nitrogen N coaxially surrounding laser beam B. Such nitrogen application for the nitriding of surfaces is well known in the art, and any suitable method for spraying or otherwise applying the nitrogen gas coaxially and simultaneously with laser beam B may be utilized. One such application of nitrogen gas to a superalloy surface during nitriding is described in U.S. Pat. No. 4,588,450, which is hereby incorporated by reference in its entirety.

Figure 3C:
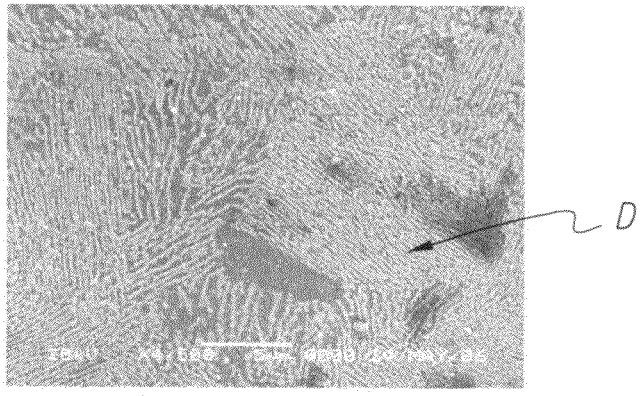
FIG. 3C is another scanning electron microscope micrograph image showing a cross-sectional view of the nitrided layer of the nickel-chromium-based superalloy workpiece of FIG. 3A, particularly illustrating very fine dendrite spacing therein.

During the laser-irradiated heating of the surface of the plate P, the nitrogen diffuses into the material, starting at the surface and working inwardly, particularly via the grain and subgrain boundary regions and the dislocation lines. The nitrogen then combines with the constituents of the superalloy to form complex nitrides. The nitride buildup (extending from the surface inwardly to a depth of approximately 40 μm) restricts the high diffusion paths and slows down the initial rate of oxidation diffusion of chromium, iron or of any other material in the alloy that would normally be oxidized. The nitriding further increases resistance against both creep and fatigue. FIG. 3C is an SEM micrograph image of the plate of FIGS. 3A and 3B, particularly illustrating a very fine dendrite spacing in the treated surface.

It is to be understood that the present invention is not limited to the embodiments described above, but encompasses any and all embodiments within the scope of the following claims.

We claim:

1. A method of nitriding nickel-chromium-based superalloys, comprising the steps of:

applying a chemical cleaning bath to a nickel-chromium-based superalloy workpiece;

ultrasonically cleaning the nickel-chromium-based superalloy workpiece;

generating a laser beam with a carbon dioxide laser;

scanning the laser beam over a surface of the nickel-chromium-based superalloy workpiece, wherein the laser beam is scanned at a rate of approximately 10 cm/sec; and spraying a stream of nitrogen gas on the surface of the nickel-chromium-based superalloy workpiece coaxially and simultaneously with the laser beam to form a barrier nitride layer thereon.

2. The method of nitriding nickel-chromium-based superalloys as recited in claim 1, wherein said step of generating the laser beam with the carbon dioxide laser comprises generating the laser beam with a power intensity of approximately 90 $W/m^2$.

3. The method of nitriding nickel-chromium-based superalloys as recited in claim 2, wherein said step of spraying the stream of nitrogen gas on the surface of the nickel-chromium-based superalloy workpiece coaxially and simultaneously with the laser beam comprises spraying pressurized nitrogen gas having a pressure of approximately 500 kPa.

4. The method of nitriding nickel-chromium-based superalloys as recited in claim 3, wherein said step of spraying the stream of nitrogen gas on the surface of the nickel-chromium-based superalloy workpiece coaxially and simultaneously with the laser beam further comprises spraying atomic nitrogen.

5. A method of nitriding nickel-chromium-based superalloys, comprising the steps of:

applying a chemical cleaning bath to a nickel-chromium-based superalloy workpiece;

ultrasonically cleaning the nickel-chromium-based superalloy workpiece;

generating a laser beam with a carbon dioxide laser;

scanning the laser beam over a surface of the nickel-chromium-based superalloy workpiece; and spraying a stream of nitrogen gas on the surface of the nickel-chromium-based superalloy workpiece coaxially and simultaneously with the laser beam to form a barrier nitride layer thereon.

* * * * *